US005987684A

United States Patent [19]

Evans

[11] Patent Number: 5,987,684

[45] Date of Patent: Nov. 23, 1999

[54] URINAL AUGER

[75] Inventor: Philip S. Evans, Lee Summit, Mo.

[73] Assignee: Phillip S. Evans, Lee Summit, Mo.

[21] Appl. No.: 09/093,361

[22] Filed: Jun. 8, 1998

Related U.S. Application Data

[60] Provisional application No. 60/042,620, Apr. 3, 1997.

[51] Int. Cl.[6] ..... B08B 9/02

[52] U.S. Cl. ..... 15/104.33; 15/104.31

[58] Field of Search ..... 15/104.05, 104.31, 15/104.32, 104.33

[56] References Cited

U.S. PATENT DOCUMENTS

| | | | |
|---|---|---|---|
| 1,844,433 | 2/1932 | Markowitz | 15/104.33 |
| 1,959,490 | 5/1934 | Mistelski | 254/134.3 FT |
| 2,044,848 | 6/1936 | Hermanson | 24/134 R |
| 2,600,707 | 6/1952 | Turnbaugh | 15/104.33 |
| 2,661,489 | 12/1953 | Rudolph et al. | 15/104.33 |
| 2,961,675 | 11/1960 | Stickney | 15/104.33 |
| 3,206,782 | 9/1965 | Larsen | 15/104.33 |
| 3,224,024 | 12/1965 | Hunt | 15/104.33 |
| 3,449,782 | 6/1969 | Hunt | 15/104.33 |
| 4,317,247 | 3/1982 | Levine | 15/104.33 |
| 4,361,924 | 12/1982 | Irwin | 15/104.33 |
| 4,552,338 | 11/1985 | Lindgren | 254/134.3 FT |
| 4,706,321 | 11/1987 | Kaye | 15/104.33 |
| 4,819,911 | 4/1989 | Cielker | 254/134.3 FT |
| 5,018,234 | 5/1991 | Meyer et al. | 15/104.33 |
| 5,230,116 | 7/1993 | Rodriguez | 15/104.33 |
| 5,265,301 | 11/1993 | Irwin | 15/104.33 |
| 5,301,382 | 4/1994 | Stout | 15/104.33 |
| 5,414,888 | 5/1995 | Irwin | 15/104.33 |

*Primary Examiner*—Mark Spisich
*Assistant Examiner*—Theresa T. Snider
*Attorney, Agent, or Firm*—George Morgan

[57] ABSTRACT

The present invention is an auger intended for, but not restricted to, clearing obstructions from urinal drains, without requiring removal of a urinal fixture from a wall. It includes a wire cable, a wire cable storage drum, at least one guide shaft along which a squeezable handle assembly that can grip the wire cable can slide, moving the wire cable out of, or back in, as required, as the squeezable handle assembly is moved along the one or more guide shafts. There is a tube that can be rotated so as to direct the wire cable as desired as well as a rubber boot to help prevent fixture damage from the device.

8 Claims, 5 Drawing Sheets

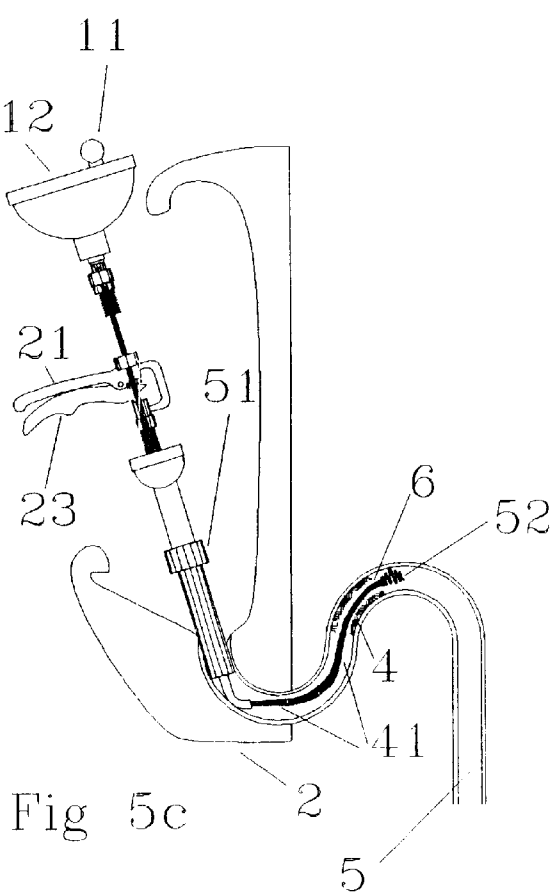
Fig 5c
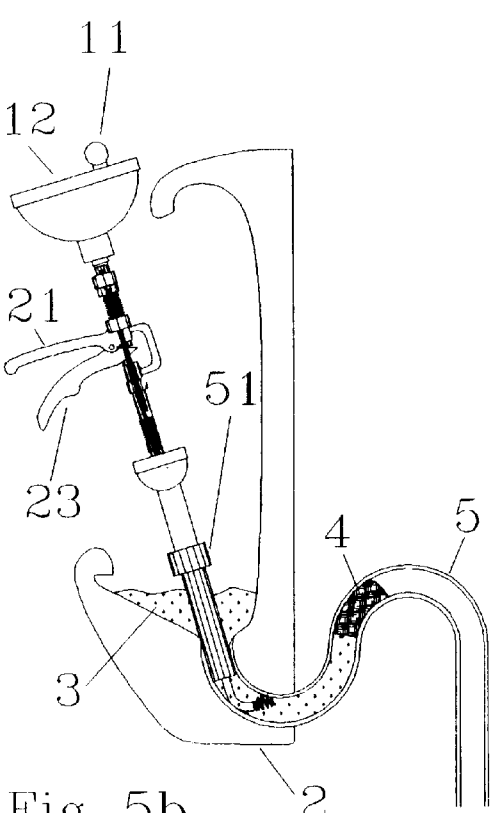
Fig 5b
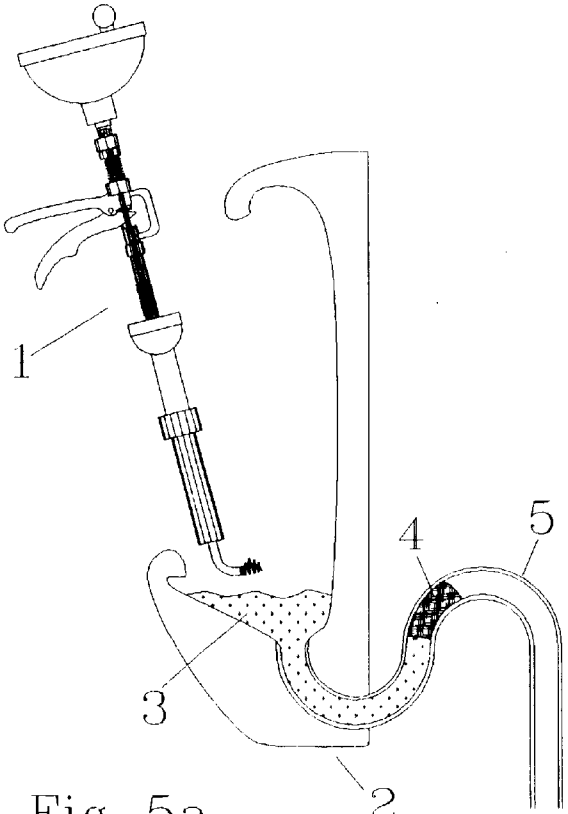
Fig 5a
Fig 5

URINAL AUGER

This application claims priority to Provisional Application No. 60/042,620, which was filed Apr. 3, 1997.

BACKGROUND OF THE INVENTION

1. Field of the Invention

The present invention is a device for clearing obstructions in a urinal.

2. Background Information

In searching prior art, the following patents were discovered:

U.S. Pat. No. 1,844,433; Feb. 9, 1932; Markowitz
U.S. Pat. No. 1,959,490; May 22, 1934; Mistelski
U.S. Pat. No. 2,600,707; Jun. 17, 1952; Turnbaugh
U.S. Pat. No. 2,044,848; Jun. 23, 1936; Hermanson
U.S. Pat. No. 2,661,489; Dec. 8, 1953; Rudolph et al
U.S. Pat. No. 3,206,782; Sept.21, 1965; Larsen
U.S. Pat. No. 3,224,024; Dec. 21, 1965; Hunt
U.S. Pat. No. 3,449,782; Jun. 17, 1969; Hunt
U.S. Pat. No. 4,317,247; Mar. 2, 1982; Levine
U.S. Pat. No. 4,361,924; Dec. 7, 1982; Irwin
U.S. Pat. No. 4,552,338; Nov. 12, 1985; Lindgren
U.S. Pat. No. 4,706,321; Nov. 17, 1987; Kaye
U.S. Pat. No. 4,819,911; Apr. 11, 1989; Cielker
U.S. Pat. No. 5,018,234; May 28, 1991; Meyer et al
U.S. Pat. No. 5,230,116; Jul. 27, 1993; Rodriguez
U.S. Pat. No. 5,265,301; Nov. 30, 1993; Irwin
U.S. Pat. No. 5,301,382; Apr. 12, 1994; Stout
U.S. Pat. No. 5,414,888; May 16, 1995; Irwin It is well known in the plumbing industry to use a spool mounted flexible cable to auger out a clog in a pipe. Prior art services however have no good way to spool out cable while keeping the plumbers hands out of the water that is usually backed up in a urinal. With concerns about aids, hepatitus, HIV, and other diseases it is more desirable than ever before for plumbers to minimize their contact with human waste. This device allows the plumber to auger out a urinal and to spool the flexible cable back up without ever touching the cable. Further, the device does not require power like some prior art augers that use a drill motor or similar device to operate an auger. The power devices lack the control of the present device.

This seems to be a crowded art. However, none of the above achieved the unclogging of urinal drains in a relatively comfortable, safe, efficient, and sanitary way.

Current practice in unclogging urinal drains usually includes removing a urinal fixture from the wall and then getting right next to the wall with a hand held snake that necessitates handling the cable which is in direct contact with waste water. A person unclogging a urinal drain has to stoop over, sit, kneel, or otherwise hunker down next to a urinal receptacle in order to unclog the drain. As infections from human waste are an occupational hazard for plumbers, it is desirable, from an occupational safety standpoint, to eliminate contact and proximity to human waste.

After the drain is unplugged, caulking has to be removed from the wall, then the fixture replaced and recaulked. This is a nasty, time consuming job, requiring skilled labor.

As will be seen in the subsequent description, these and other shortcomings of the present are overcome by the preferred embodiment of the present invention.

SUMMARY OF THE INVENTION

The present invention is a device that simplifies removing obstructions that occur in urinal drains, usually found in the piping within ten feet of a urinal fixture. The device includes a rotatable cable storage drum that holds a flexible cable, a structure that supports the rotatable cable storage drum with cable, said structure including guides with a slidable handle assembly that facilitates a rapid cable feed within the device exiting a tube with an elbow that directs the cable into the urinal piping.

BRIEF DESCRIPTION OF THE DRAWINGS

FIG. 1 shows various views of the present invention.

FIG. 5 illustrates an application of the present invention.

DESCRIPTION OF THE PREFERRED EMBODIMENTS

Figure 8:
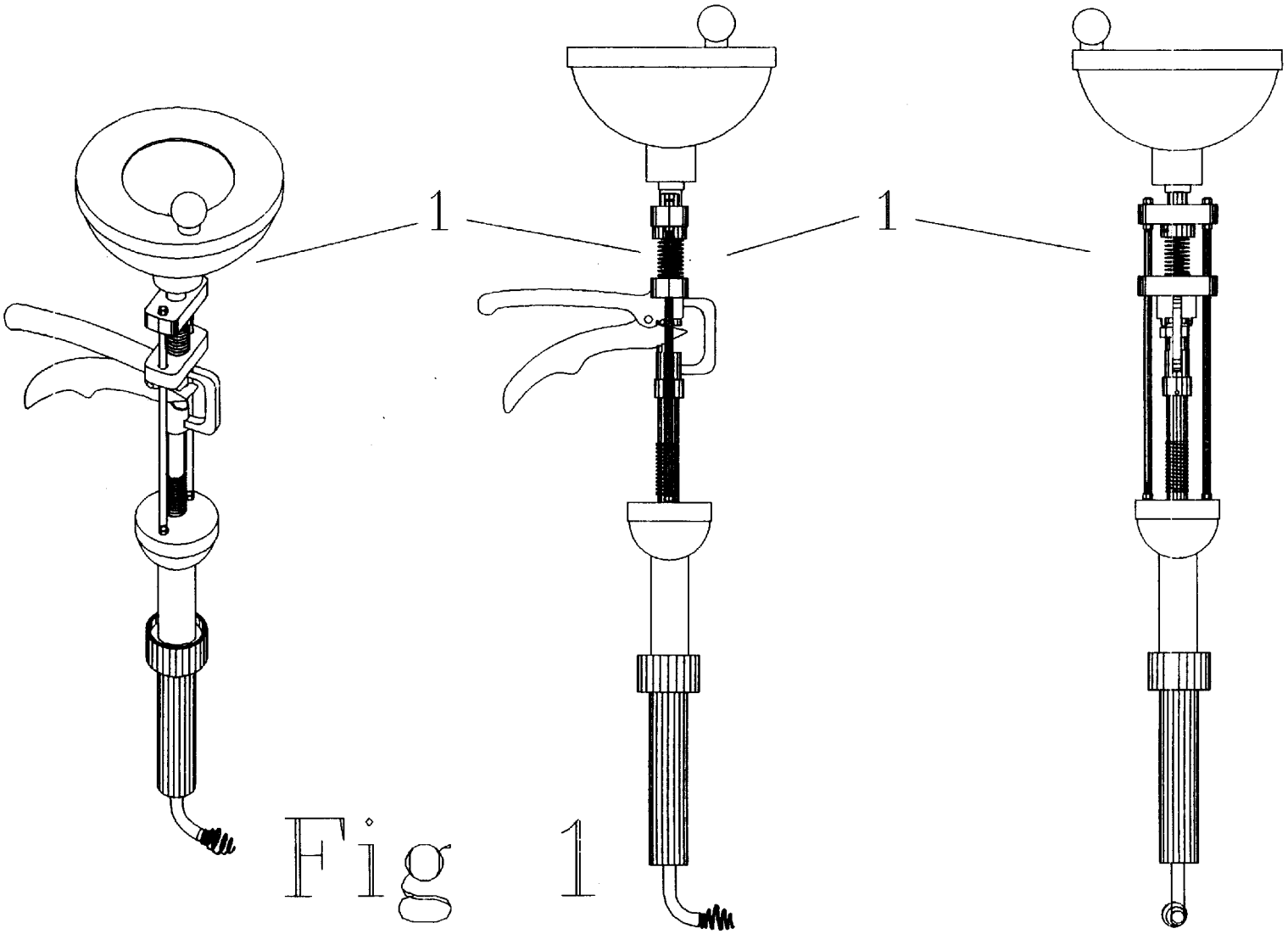

FIG. 5 which includes the FIGS. 5*a*, 5*b*, and 5*c*, illustrates an auger 1 applied to a urinal 2 with a drain 5 containing a blockage 4 with backed up waste and water 3. FIG. 5*c* illustrates an opening 6 cleared by the auger 1 in the blockage 4.

FIG. 1 includes overall views of the auger 1.

FIGS. 2, 3, 4, and 5 illustrate the auger 1 comprising a cable storage drum assembly 10, a squeeze handle assembly 20, a lower assembly 40, and a cable 41.

Figures 2, 2A:
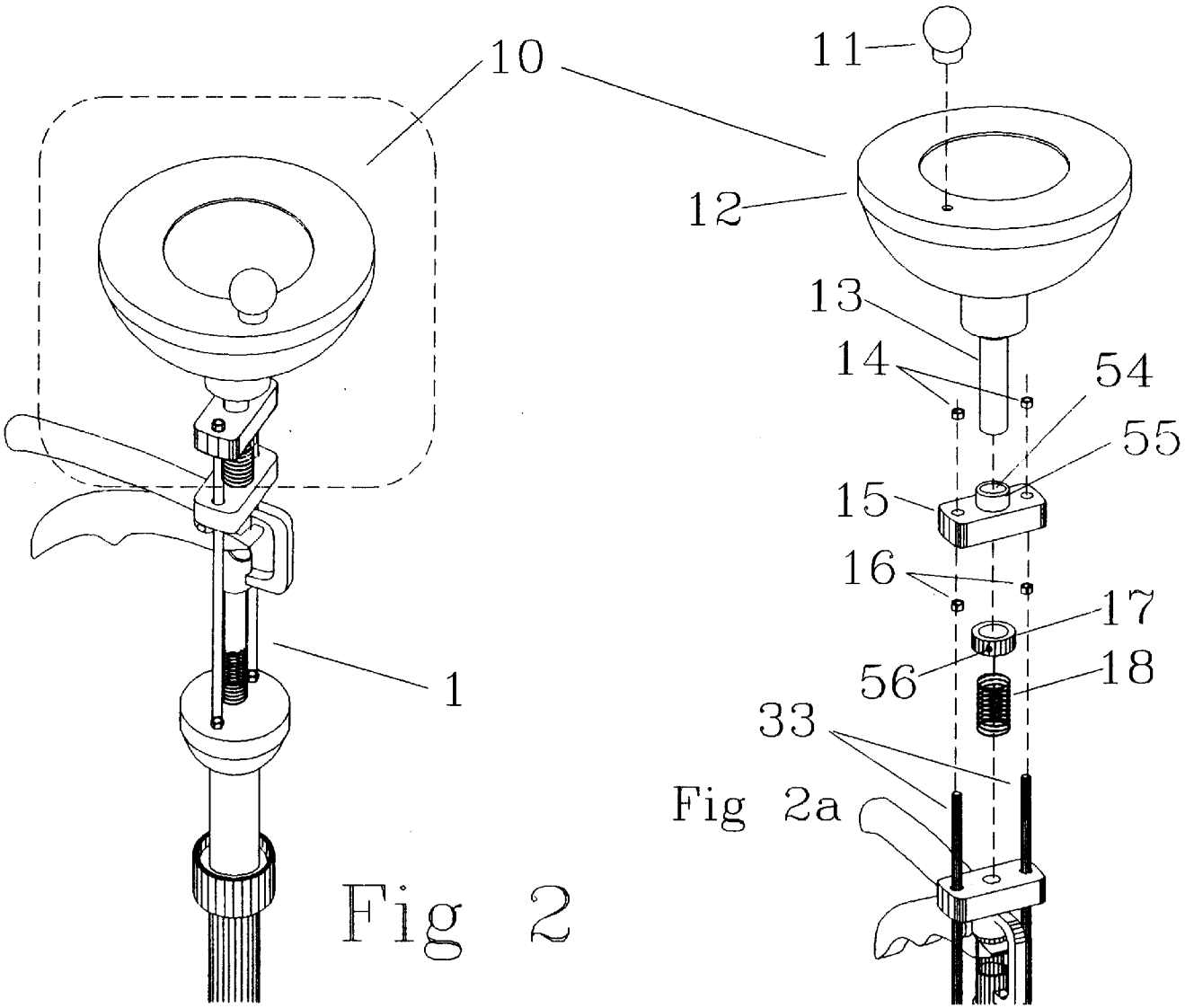
FIGS. 2 and 2*a* illustrate a top portion of the present invention.

Referring to FIGS. 2 and 2*a*, the cable storage drum assembly 10 includes a cable storage drum 12 with a hand grip 11, a guide tube 13, a drum mount 15 with raised bushing with clearance, and a set-collar with set screw 17. The guide tube 13 goes through the drum mount 15 with raised bushing with clearance, and then the set-collar with set screw 17 is set in place on the guide tube 13, with the drum mount 15 above the set-collar 17. The guide tube 13 guides the cable 41 from the cable storage drum assembly 10. The guide tube 13 also acts as a rotation shaft for the cable storage drum 12 while the cable storage drum 12 is being rotated to feed out, or draw back in the cable 41.

Figure 3A:
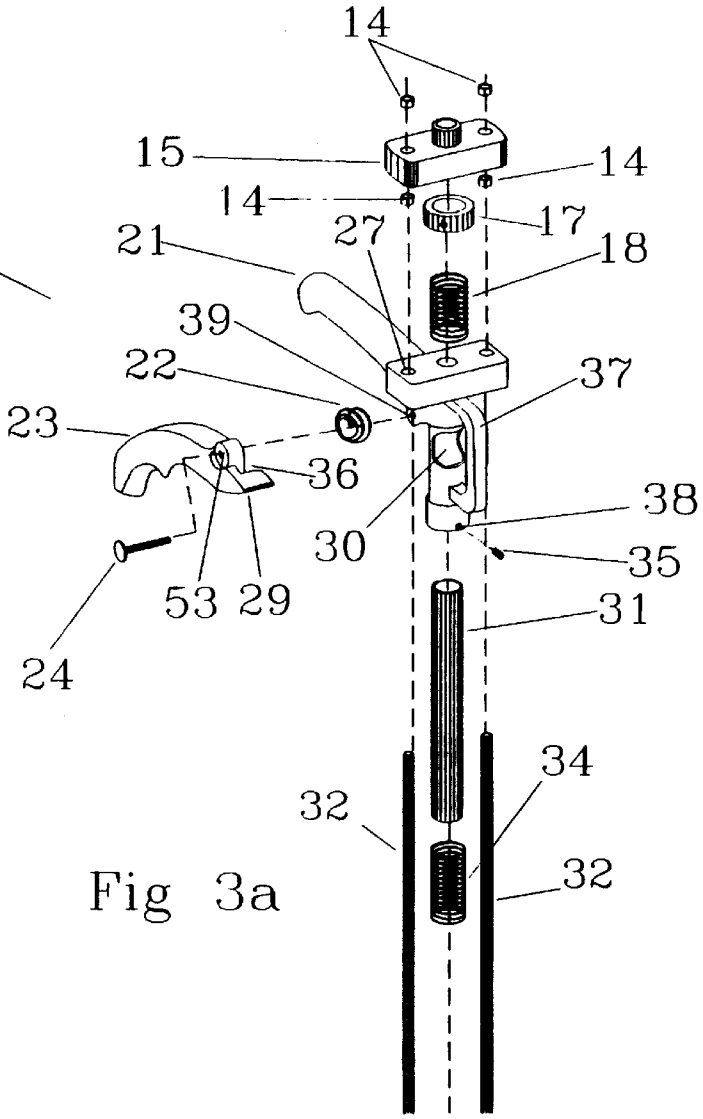
FIGS. 3 and 3*a* illustrate a feeder mechanism portion of the present invention.
Figure 3:
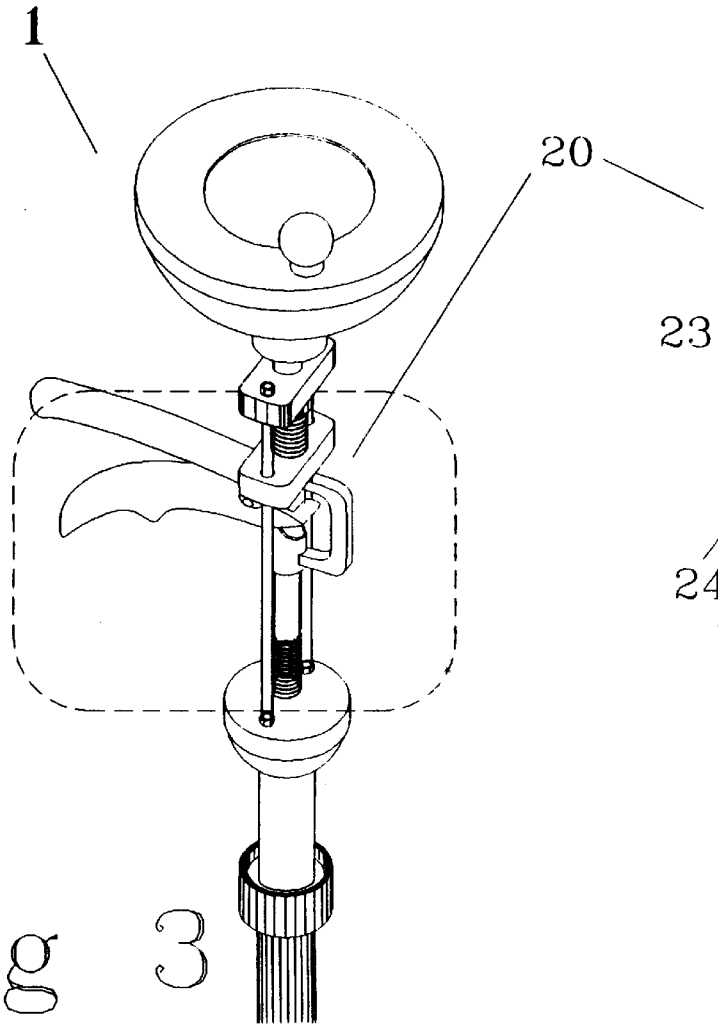

Referring to FIGS. 2*a*, 3, and 3*a*, the squeeze handle assembly 20 which is used to feed the cable 41 through the auger 1 comprises a handle 21, an upper spring 18, a return spring 22, a cable grip squeeze lever 23, a hinge pin 24, a set screw 35, a guide tube 31, a lower spring 34, and guide shafts 32 with threaded ends 33 and nuts 14. The squeeze handle 21 has guide shaft clearances 27, a notch 30, a reinforcement 37, a set screw threaded clearance 38, and a pin clearance 39. The cable grip squeeze lever 23 includes a pawl 29, a side clearance 36, and a hinge pin clearance 53. The cable grip squeeze lever 23 is affixed to the handle 21 by means of a hinge pin 24 through the hinge pin clearance 53 in the cable grip squeeze lever 23 and the pin clearance 39 in the handle 21. The hinge pin 24 can be a threaded pin and a nut used to secure it in position or the hinge pin 24 can be headed after it is in position. The return spring 22 is contained between the cable grip squeeze lever 23 and the handle 21 so as to return the cable squeeze lever 23 to an at rest position as indicated in FIG. 5a. The nuts 14 secure the mount 15 to the guide shafts with threaded ends 33. As indicated in FIGS. 2 and 2*a*, the cable storage drum 12 is supported by the drum mount 15.

In the operation of the auger 1, the upper spring 18 and the lower spring 32 each act as a shock absorber spring. The upper spring 18 absorbs shock from upward impacts imposed by the handle 21. The lower spring 32 absorbs shock from downward impacts imposed by the guide tube 31 which is attached to the handle 21 by means of the set screw 35 through the set screw threaded clearance 38 in the preferred embodiment of the present invention.

Figures 4, 4A:
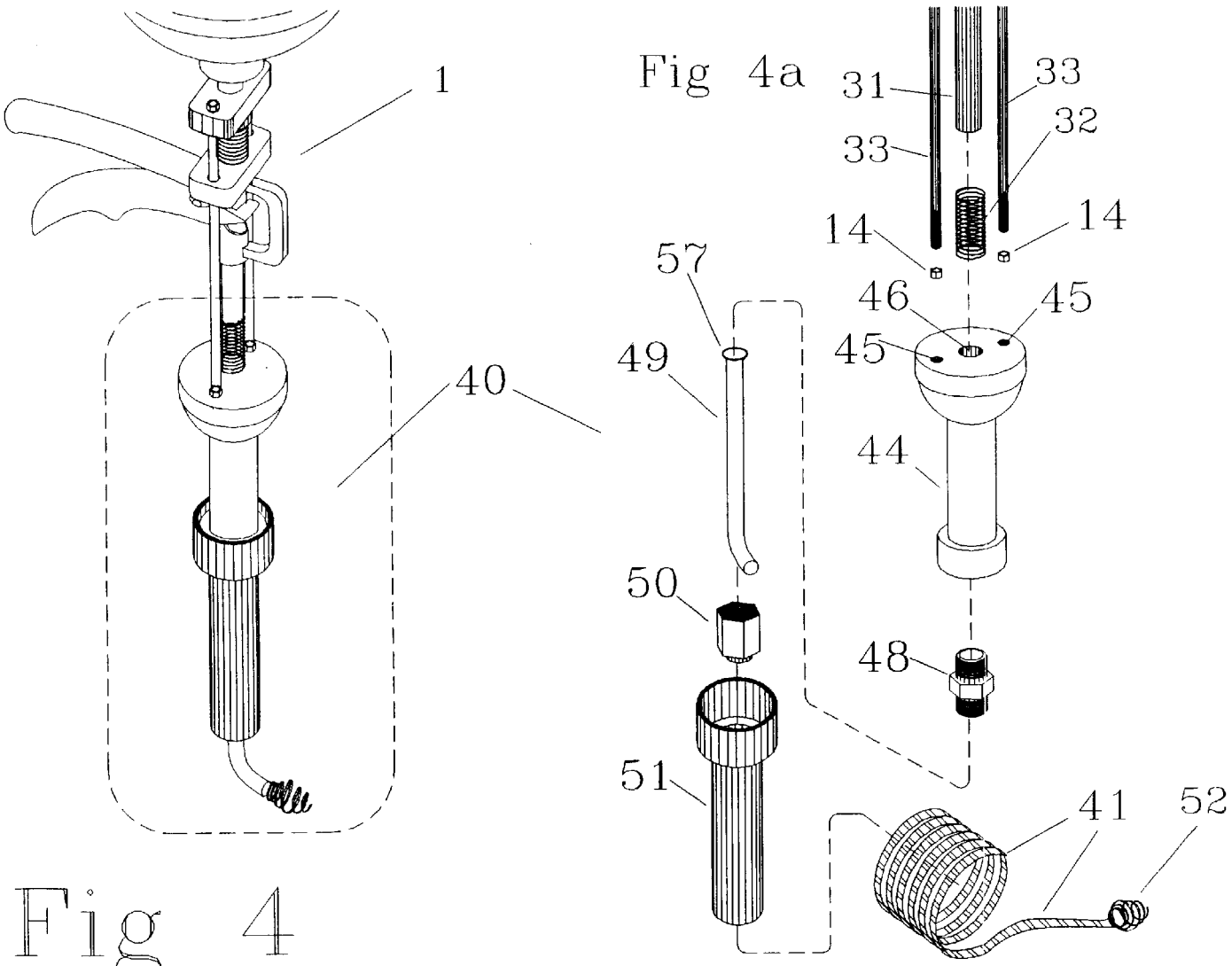
FIGS. 4 and 4*a* illustrate a lower portion of the present invention.

As shown in FIGS. 4 and 4*a*, the lower assembly 40 includes a lower spring 32, a base 44, a coupler 48, a directional tube 49, an attachment nut 50, and a rubber boot 51. The base 44 includes threaded apertures 45 and a base clearance 46. The guide shafts 33 screw into the threaded apertures 45 and then are locked in place by the nuts 14. The base clearance 46 provides clearance for passage of the cable 41. The cable 41 is typically a flexible steel wire cable with an expanded coil wire tip 52. The directional tube 49 has a flared end 57 which is secured to the coupler 48 by means of the attachment nut 50 fitting over the flared end 57, which forms a compression fit between the attachment nut 50 and the coupler 48. This arrangement permits the directional tube 49 to be rotated to and fixed in the most efficient position as for operation as required. The rubber boot 51 which is installed over the end of the base 44, reduces the chance of scratching or chipping a urinal 2 while it is being operated on with the auger 1.

To unclog a drain pipe 5 in a urinal 2, as shown in FIG. 5*a*, the auger 1 is placed in position as shown in FIG. 5*b*. With the handle 21 (Ref FIG. 3*a*) pulled as far up as it will go, towards the upper mount 15, the cable grip squeeze lever 23 is squeezed manually towards the handle 21. The cable 41 which is contained in the clearance 36 of the cable grip squeeze lever 23, is pulled by the pawl 29 which engages the cable 41 against inside of the handle 21 as seen in the notch 30 of the handle 21. The cable 41 is, by this sequence, firmly gripped between the cable grip squeeze lever 23 and the handle 21. Then, when an operator pushes down on the handle 21, the squeeze handle assembly 21 moves downward along guide tube 31, pulling cable 41 out of the cable storage drum 21, pushing the cable 41 through the auger 1 the amount of travel of the squeeze handle assembly 21 towards the base 44. If additional cable 41 needs to be fed out, the operator releases the cable grip squeeze lever 23 and pulls the squeeze handle assembly 21 as far up as it will go, towards the upper mount 15, and repeats the process. If required, one can rotate the cable storage drum 12 by means of the grip 11, so the cable 41 augers through the obstruction 4. Once the obstruction 4 is cleared, one can return the cable 41 into the cable storage drum 12 by reversing the process used to feed the cable 41 out of the cable storage drum 12.

Cable 41 in the preferred embodiment of the present invention is a typical flexible coiled steel cable, known as an auger cable, such as is popular in and well known to the plumbing industry. In the preferred embodiment of the present invention, a 5/16 inch diameter 25 foot long steel flexible cable with an expanded coil tip such as the cable tip 52 works quite well in the intended application. Most obstructions 4 in urinal drains 5 occur within ten feet of the urinal 2.

The directional tube 49 assists the operator in getting the cable tip 52 started in the urinal 2.

By twisting and extending additional lengths of cable 41 a obstruction 4 can be augered out of the urinal 2 and connected drain 5. When finished unclogging a urinal 2, the operator can either spool the cable 41 into the cable storage drum 12 or, simpler yet, work the cable 41 back into the cable storage drum 12 by engaging the cable 41 with the squeeze handle assembly 20 and pulling the cable 41 out of the drain 5. The cable 41 will feed into the cable storage drum 12 without the need to rotate the cable storage drum 12 by means of the grip 11.

Referring to FIG. 5, in operation a plumber places the auger 1 in the urinal 2. Placing an axial force against the handle 21 keeps the rubber boot 51 in tight engagement with the urinal 2. Then the operator squeezes the lever 23 and pushes the handle 21 which slides a section of gripped cable 41 into the drain pipe 5 of the urinal 2 until it encounters the clog 4. Then, while still pushing axially on the handle 21 with one hand the operator can simultaneously turn the grip 11 to auger the clog 4 with his other hand. If the clog 4 is a tough one, the wire tip 52 will load up and the operator will be able to feel this resistance. In this situation, the operator can put less axial force on the handle 21, thus backing off to taking a less aggressive bite. It is this spring feedback that helps the operator avoid too much force that might damage the drain pipe 5 or the urinal auger 1 as is common with power equipment.

As can be seen from the description and drawings, the auger 1 can be operated without the operator touching the cable or having hands in the waste water. Also, the auger 1 is operated by an operator who is standing erect as opposed to an operator having to stoop over, sit, kneel, or otherwise hunker down next to a urinal receptacle in order to unclog a drain. The present invention reduces some of the risk of infections from human waste now incurred in unclogging urinal drain obstructions. Also less time and less skill is required to unclog a urinal drain with the present invention than it does the prior art. This is of great economic advantage for large institutions such as hospitals and large office buildings.

In the preferred embodiment of the present invention, the parts typically are of metal, such as aluminum or steel. The cable 4 and the cable tip 52 are of steel, in the preferred embodiment of the present invention. The handle 21, in the preferred embodiment of the present invention can be wood or a suitable plastic as an alternative to steel or aluminum.

Although the description above contains many specificities, these should not be construed as limiting the scope of the invention but as merely providing illustrations of some of the presently preferred embodiments of this invention. For example, while the description of the preferred embodiments of the present invention is directed toward unclogging urinal drain obstructions, the invention is also useful in unclogging drains for other types of fixtures including sinks, commodes, tubs and showers as well as drains in general. Thus the scope of the invention should be determined by the appended claims and their legal equivalents rather than by the examples given.

I claim:

1. A device for unclogging drains comprising:

a) a rotatable cable storage drum;

b) a mount supporting the rotatable cable storage drum;

c) at least one guide shaft affixed to the mount supporting the rotatable cable storage drum;

d) a cable with an expanded wire tip;

e) a squeeze handle assembly that is slideable along the at least one guide shaft, for feeding cable out of, or into, the rotatable cable storage drum through said device, said squeeze handle assembly comprising a handle with a lever, said lever attached and movable with respect to the handle, said handle and lever gripping said cable when the lever is squeezed against the handle, so said cable is movable along with the squeeze handle assembly; and f) a base to which the at least one guide shaft is also affixed, said base supporting the at least one guide shaft along which at least one guide shaft the squeeze handle assembly is slideable.

2. The device of claim 1 further comprising a directional tube mounted to the base, said tube directing the cable towards a drain.

3. The device of claim 1 further comprising a directional tube mounted to the base, where said directional tube is flared at an end secured to the base with a compression fitting so that the direction of the tube can be rotated as desired by loosening the compression fitting.

4. The device of claim 1 further comprising a removable rubber boot which is attached to said base for the purpose of protecting drain fixtures from damage.

5. The device of claim 1 further comprising at least one spring located between said squeeze handle assembly and said mount supporting the rotatable storage drum, said at least one spring acting as a shock absorber.

6. The device of claim 1 wherein the squeeze handle assembly comprises a return spring.

7. The device of claim 1 further comprising at least one spring located between said squeeze handle assembly and said base, said at least one spring acting as a shock absorber.

8. A device for unclogging drains comprising:

a) a rotatable cable storage drum;

b) a mount supporting the rotatable cable storage drum;

c) at least one guide shaft affixed to the mount supporting the rotatable cable storage drum;

d) a cable with an expanded wire tip;

e) a squeeze handle assembly that is slideable along the at least one guide shaft, for feeding cable out of, or into, the rotatable cable storage drum through said device, said squeeze handle assembly comprising a handle with a lever, said lever attached and movable with respect to the handle, said handle and lever gripping said cable when the lever is squeezed against the handle, so said cable is movable along with the squeeze handle assembly; and f) a base to which the at least one guide shaft is also affixed, said base supporting the at least one guide shaft along which the squeeze handle assembly is slideable, wherein said device is used as a means to clear obstructions from urinal drains without removing a urinal fixture from a wall.

* * * * *